US008324568B2

(12) United States Patent
Shiokawa et al.

(10) Patent No.: US 8,324,568 B2
(45) Date of Patent: Dec. 4, 2012

(54) MASS SPECTROMETER AND MASS SPECTROMETRY METHOD

(75) Inventors: Yoshiro Shiokawa, Hachioji (JP); Yoshiki Hirano, Fuchu (JP); Megumi Nakamura, Tama (JP); Yasuyuki Taneda, Inagi (JP); Qiang Peng, Narusawa-mura (JP); Harumi Maruyama, Inagi (JP)

(73) Assignee: Canon Anelva Corporation, Kanagawa-Ken (JP)

( * ) Notice: Subject to any disclaimer, the term of this patent is extended or adjusted under 35 U.S.C. 154(b) by 141 days.

(21) Appl. No.: 12/794,665

(22) Filed: Jun. 4, 2010

(65) Prior Publication Data

US 2010/0243884 A1 Sep. 30, 2010

Related U.S. Application Data

(63) Continuation of application No. PCT/JP2009/004215, filed on Aug. 28, 2009.

(30) Foreign Application Priority Data

Sep. 30, 2008 (JP) ..... 2008-253915

(51) Int. Cl.
*H01J 49/26* (2006.01)

(52) U.S. Cl. ..... 250/288

(58) Field of Classification Search ..... 250/288, 250/281, 282

See application file for complete search history.

(56) References Cited

U.S. PATENT DOCUMENTS

| | | | | |
|---|---|---|---|---|
| 7,952,069 | B2 * | 5/2011 | Shiokawa et al. | 250/282 |
| 2009/0266979 | A1 | 10/2009 | Nakamura et al. | |
| 2009/0266981 | A1 | 10/2009 | Shiokawa et al. | |
| 2009/0272894 | A1 | 11/2009 | Shiokawa et al. | |
| 2010/0163722 | A1 * | 7/2010 | Shiokawa et al. | 250/282 |

FOREIGN PATENT DOCUMENTS

| | | | |
|---|---|---|---|
| JP | 06-011485 | A | 1/1994 |
| JP | 09-243602 | A | 9/1997 |
| JP | 10-232221 | A | 9/1998 |
| JP | 2001-165829 | A | 6/2001 |
| JP | 2007-322365 | A | 12/2007 |
| JP | 2008-164383 | A | 7/2008 |
| WO | 2008/156080 | A | 12/2008 |

OTHER PUBLICATIONS

Megumi Nakamura, et al., "Evolved Gas Analysis by Ion Attachment Mass Spectrometry (IAMS)", Abstracts of Speech at Annual Conference on Mass Spectrometry, vol. 56, May 2008, pp. 428-429.

(Continued)

*Primary Examiner* — Kiet T Nguyen

(74) *Attorney, Agent, or Firm* — Fitzpatrick, Cella, Harper & Scinto

(57) ABSTRACT

A mass spectrometer includes an ionization chamber (100) which generates fragment-free ions to be detected from an introduced gas to be detected, and a mass spectrometer chamber (140) including a mass spectrometer (160) which fractionates by mass the ions to be detected that are transported from the ionization chamber and which detects the ions. The mass spectrometer further includes a probe (111) which holds a liquid sample or a solid sample and causes the liquid sample or the solid sample to generate the gas to be detected upon heating by a heating means, and a gas introduction means (170) which introduces a predetermined gas from the probe to the ionization chamber to transport, to the ionization chamber, the gas to be detected that is generated at the probe.

8 Claims, 5 Drawing Sheets

OTHER PUBLICATIONS

Lei Chen, et al., "Lithium Ion Attachment Mass Spectrometry for the Direct Detection of Organoarsenic Compounds in the Metallomics Studies", Chemistry Letters, vol. 36, No. 2, 2007, pp. 336-337.

R.V. Hodges, et al., "Application of Alkali Ions in Chemical Ionization Mass Spectrometry", Analytical Chemistry, vol. 48, No. 6, pp. 825-829, 1976.

Daniel Bombick, et al. "Potassium Ion Chemical Ionization and Other Uses of an Alkali Thermioninc Emitter in Mass Spectrometry", Analytical Chemisty, vol. 56, No. 3, pp. 396-402, 1984.

Toshihiro Fujii, et al. "Chemical Ionization Mass Spectrometry with Lithium Ion Attachment to the Molecule", Analytical Chemistry, vol. 61, No. 9, pp. 1026-1029, 1989.

Toshihiro Fujii, "A Novel Method for Detection of Radical Species in the Gas Phase: Usage of Li+ Ion Attachment to Chemical Species", Chemical Physics Letters, vol. 191, No. 1,2, pp. 162-168, 1992.

U.S. Appl. No. 12/645,610, filed Dec. 23, 2009, Inventors: Yoshiro Shiokawa, et al.

International Search Report and Written Opinion dated Sep. 10, 2009 from corresponding International Application PCT/JP2009/004215.

Ionicon PTR-MS, http://www.ptrms.com/index.html, last accessed Jun. 17, 2010.

V&F, http://www.vandf.com/page.cfm?vpath=products, last accessed Jun. 17, 2010.

* cited by examiner

MASS SPECTROMETER AND MASS SPECTROMETRY METHOD

This application is a continuation of International Application No. PCT/JP2009/004215, filed Aug. 28, 2009, the contents of which are incorporated herein by reference.

TECHNICAL FIELD

The present invention relates to a mass spectrometer and mass spectrometry method that perform mass analysis by evaporating a solid or liquid sample.

BACKGROUND ART

According to mass spectrometry, the molecules of a sample component are ionized. Then, the ions are electromagnetically fractionated by mass (mass number), and the ion intensity is measured. The former part for ionization is called an ionization unit (ionizer), and the latter part for mass fractionation is called a mass spectrometry unit (mass spectrometer). The mass spectrometry is typical of instrumental analysis methods because of its high sensitivity and precision, and is applied to a wide range of fields including material development, product inspection, environmental research, and biotechnology. Most mass spectrometers are used in combination with a component separator such as a gas chromatograph (GC). In this case, however, the following problems arise. A sample needs to be refined for component separation. As long as several tens of minutes is required till the end of component separation. A sample component may change in quality or be lost during component separation. Component separation requires a deep knowledge and considerable experience.

For a quick, simple, and high-precision measurement, a "direct measurement method" is also employed, in which a mass spectrometer singly performs measurement without being combined with a component separator.

Ionizers used in the "direct measurement method" are greatly different in principle and structure. An ion attachment mass spectrometer is advantageous because it can analyze the mass of a gas to be detected without dissociation. Conventional ion attachment mass spectrometers are reported in non-patent references 1 to 3 and patent reference 1.

FIG. 5 shows a conventional ion attachment mass spectrometer that evaporate a solid or liquid sample and measures the mass number of the sample.

In FIG. 5, an ionization chamber 100 and sample evaporation chamber 110 are arranged in a first cell 130. A mass spectrometer 160 is arranged in a second cell 140. A vacuum pump 150 evacuates the first cell 130 and second cell 140. Hence, all the ionization chamber 100, sample evaporation chamber 110, and mass spectrometer 160 are maintained in a pressure atmosphere (vacuum) lower than the atmospheric pressure.

An emitter 107 made of alumina silicate containing an alkali metal oxide as of lithium is heated to generate and emit positively charged metal ions 108 such as $Li^+$. The sample evaporation chamber 110 is arranged separately from the ionization chamber 100, which chambers are connected by a connecting pipe 120.

A probe 111 is inserted into the sample evaporation chamber 110 from the outside (from the left in FIG. 5) to heat a sample cup 112 provided at the distal end of the probe 111. Since the sample cup 112 is filled with a sample 113, the sample 113 is evaporated and releases neutral gas phase molecules 106 of the sample 113 as a gas to be detected in the sample evaporation chamber 110. The neutral gas phase molecules 106 move toward the ionization chamber 100 by self-diffusion and enter it.

In the ionization chamber 100, the neutral gas phase molecules 106 are ionized, generating ions.

Finally, the generated ions are transported from the ionization chamber 100 to the mass spectrometer 160 upon receiving a force from an electric field. The mass spectrometer 160 fractionates the ions for respective masses and detects them.

The metal ions 108 attach to portions of the neutral gas phase molecules 106 that have charge bias. The molecules (ion-attached molecules 109) with the metal ions 108 attached form ions that are positively charged overall. The neutral gas phase molecules 106 do not decompose because attaching energy (energy for attachment which turns into excess energy after attachment) is very small. The ion-attached molecules 109 therefore act as molecular ions without changing from the original molecular form.

Molecular ions that keep the original molecular form, like the ion-attached molecules 109, will be called fragment-free ions. When the ion-attached molecules 109 generate ions to be detected, these ions will be called fragment-free ions to be detected.

If, however, the ion-attached molecules 109 are left stand (keep holding excess energy) after the metal ions 108 attach to the neutral gas phase molecules 106, the excess energy breaks bonds between the metal ions 108 and the neutral gas phase molecules 106. The metal ions 108 move apart from the neutral gas phase molecules 106 and return to original neutral gas phase molecules 106. To prevent this, the ion-attached molecules 109 are caused to frequently collide against gas molecules by introducing gas such as $N_2$ gas (nitrogen gas) from a gas cylinder 170 into the ionization chamber 100 up to a pressure of about 50 to 100 Pa (flow rate of 5 to 10 sccm). Then, excess energy held by the ion-attached molecules 109 moves to the gas molecules to stabilize the ion-attached molecules 109.

This gas has an important function in the ion attachment process to make metal ions 108 emitted by the emitter 107 collide against each other so that the metal ions 108 are decelerated and easily attach to the neutral gas phase molecules 106. This gas is called a third-body gas.

As shown in FIG. 5, the third-body gas cylinder 170 is connected to the ionization chamber 100 via a pipe so that it can introduce a third-body gas into the ionization chamber 100.

In the above-mentioned ion attachment mass spectrometer, the emitter is arranged on the central axis and emits the metal ions 108 along the central axis (lateral direction in FIG. 5). This structure requires the sample evaporation chamber 110 in addition to the ionization chamber 100. The opening of the sample cup 112 arranged inside the sample evaporation chamber 110 is perpendicular (upward in FIG. 5) to the central axis. The neutral gas phase molecules 106 are released in a direction (upward in FIG. 5) perpendicular to the central axis.

One reason of this arrangement is as follows. The metal ions 108, which are primary particles used for ionization, are low-speed ions and are effectively affected by an electric field within the ionization chamber 100, similar to the generated ion-attached molecules 109. The metal ions 108 need to be emitted along the central axis, and thus the emitter is located on the central axis of the structure.

Prior Art References

Patent Reference

Patent Reference 1: Japanese Patent Laid-Open No. 6-11485

Non-Patent References

Non-Patent Reference 1: Hodge (Analytical Chemistry vol. 48, No. 6, p. 825 (1976))

Non-Patent Reference 2: Bombick (Analytical Chemistry vol. 56, No. 3, p. 396 (1984))

Non-Patent Reference 3: Fujii (Analytical Chemistry vol. 61, No. 9, p. 1026, Chemical Physics Letters vol. 191, no. 1.2, p. 162 (1992))

DISCLOSURE OF INVENTION

Problems that the Invention is to Solve

According to the ion attachment method, the presence of $N_2$ at about 50 to 100 Pa is significant in vacuum. Since a distance (mean free path) at which the neutral gas phase molecules 106 can travel straight without collision against $N_2$ is about 0.1 mm, an upward kinetic energy of several eV disappears soon.

In the ion attachment method, the weight (molecular weight) of an evaporated component is often heavier than the atmosphere and no buoyant force is generated for a component heavier than the $N_2$ atmosphere. The neutral gas phase molecules 106 are expected not to move up but to sink. However, the neutral gas phase molecules 106 tend to diffuse (move at random by the thermal effect), so some neutral gas phase molecules 106 surely travel upward. That is, the neutral gas phase molecules 106 need to move up but their ascending force is estimated to be weak.

It is an object of the present invention to achieve excellent performance (sensitivity, reproducibility, responseness, and memory) in a mass spectrometer that performs mass analysis by evaporating a solid or liquid sample.

Means of Solving the Problems

To achieve the above object, according to the present invention, a mass spectrometer including an ionization chamber which generates fragment-free ions to be detected from an introduced gas to be detected, and a mass spectrometer chamber including a mass spectrometer which fractionates by mass the ions to be detected that are transported from the ionization chamber and which detects the ions comprises a probe which holds a liquid sample or a solid sample and causes the liquid sample or the solid sample to generate the gas to be detected upon heating by heating means, and gas introduction means for introducing a predetermined gas from the probe to the ionization chamber to transport, to the ionization chamber, the gas to be detected that is generated at the probe.

Further, according to the present invention, a mass spectrometry method using a mass spectrometer including an ionization chamber which generates fragment-free ions to be detected from an introduced gas to be detected, a mass spectrometer chamber having a mass spectrometer which fractionates by mass the ions to be detected that are transported from the ionization chamber and which detects the ions, and a probe which holds a liquid sample or a solid sample and causes the liquid sample or the solid sample to generate the gas to be detected upon heating by heating means comprises introducing a predetermined gas from the probe to the ionization chamber to transport, to the ionization chamber, the gas to be detected that is generated at the probe upon heating.

Effects of the Invention

The present invention can achieve excellent performance (sensitivity, reproducibility, responseness, and memory).

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Embodiments of the present invention will now be described in detail with reference to the accompanying drawings. However, the following embodiments are merely examples of the implementation means of the invention, and should be properly changed or modified depending on various conditions and the structure of an apparatus to which the invention is applied, and the invention is not limited to the embodiments described herein.

(First Embodiment)

Figure 1:
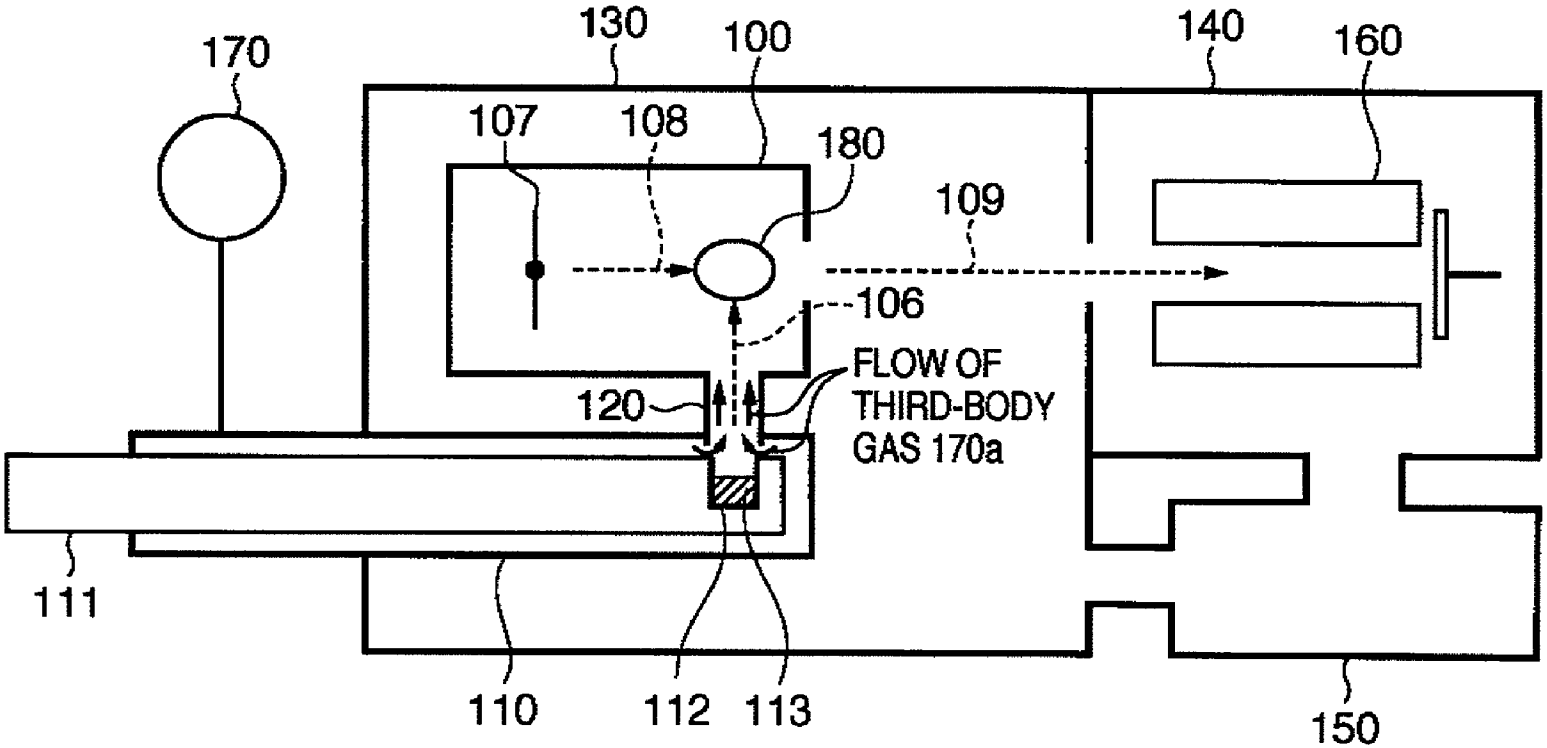
FIG. 1 is a sectional view showing the overall arrangement of a mass spectrometer according to the first embodiment of the present invention.

FIG. 1 shows a mass spectrometer according to the first embodiment of the present invention.

The ionization method is an ion attachment method capable of fragment-free ionization to generate the molecular ions of neutral gas phase molecules of a gas to be detected.

As shown in FIG. 1, an ionization chamber 100 and sample evaporation chamber 110 are arranged in a first cell 130. A mass spectrometer 160 is arranged in a second cell 140 (serving as a mass spectrometer chamber). A vacuum pump 150 evacuates the first cell 130 and second cell 140. Hence, all the ionization chamber 100, sample evaporation chamber 110, and mass spectrometer 160 are maintained in a pressure atmosphere (vacuum) lower than the atmospheric pressure. In this case, the ionization chamber 100 and sample evaporation chamber 110 are arranged in the first cell 130. Instead, the ionization chamber 100 and sample evaporation chamber 110 may build the first cell 130.

An emitter 107 made of alumina silicate containing an alkali metal oxide as of lithium is heated to generate and emit positively charged metal ions 108 such as $Li^+$. The sample evaporation chamber 110 is arranged separately from the ionization chamber 100, which chambers are connected by a connecting pipe 120. The emitter 107 functions as an ion emitter.

The center inside the ionization chamber 100 where fragment-free ions are generated is defined as a target detection ion generation region 180. In the ion attachment method using the emitter 107 as shown in FIG. 1, the target detection ion generation region is a region centered at an intersection point between a plane parallel to the bottom of the ionization chamber 100 and a center line passing through the center of the connecting pipe 120.

A probe 111 is inserted into the sample evaporation chamber 110 from the outside to heat a sample cup 112 that is provided at the distal end of the probe 111 and serves as the holder of a sample 113. The sample can be heated by heating the sample cup by an indirect heater or directly by a direct heater. The heating means is an indirect heater or direct heater. The sample 113 is a liquid or solid sample.

Note that the connecting pipe 120 is not always necessary. It is also possible to, for example, partition the ionization chamber 100 and sample evaporation chamber 110 by a wall and simply make a hole in the wall.

Since the sample cup 112 is filled with the sample 113, the sample 113 is evaporated and releases neutral gas phase molecules 106 (serving as a gas to be detected) of the sample 113 in the sample evaporation chamber 110. The neutral gas phase molecules 106 move toward the ionization chamber 100 and enter it. Then, the neutral gas phase molecules 106 are ionized in the ionization chamber 100, generating ion-attached molecules 109 (serving as ions to be detected). The probe 111 is arranged below the horizontal plane passing through the target detection ion generation region 180.

Finally, the generated ion-attached molecules 109 are transported from the ionization chamber 100 to the mass spectrometer 160 upon receiving a force from an electric field. The mass spectrometer 160 fractionates the ions by mass (mass fractionation), and detects them.

Figure 5:
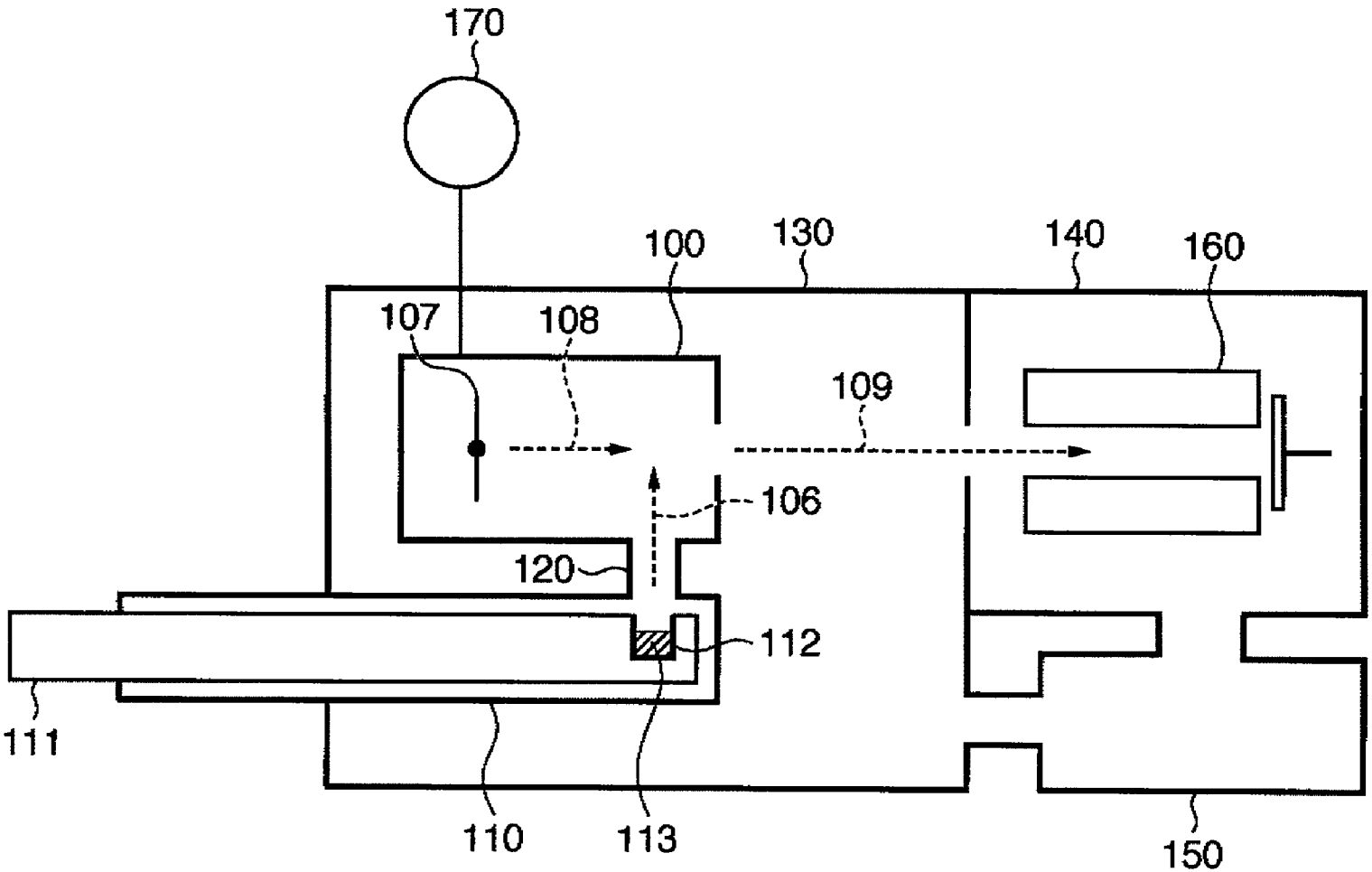
FIG. 5 is a sectional view showing the overall arrangement of a conventional ion attachment mass spectrometer which evaporates a solid or liquid sample and measures the mass number of the sample.

The above description is the same as that of the mass spectrometer shown in FIG. 5. However, the arrangement of the embodiment is different from that of FIG. 5 in the following point.

In FIG. 5, the third-body gas cylinder 170 serving as a third-body gas introduction means is connected to the ionization chamber 100. However, in the mass spectrometer according to the embodiment, a third-body gas cylinder 170 is connected to the sample evaporation chamber 110 as an example of the third-body gas introduction mechanism so that a third-body gas 170*a* (serving as a carrier gas) such as nitrogen gas can be introduced into the ionization chamber 100 via the sample evaporation chamber 110 and connecting pipe 120.

Figure 2:
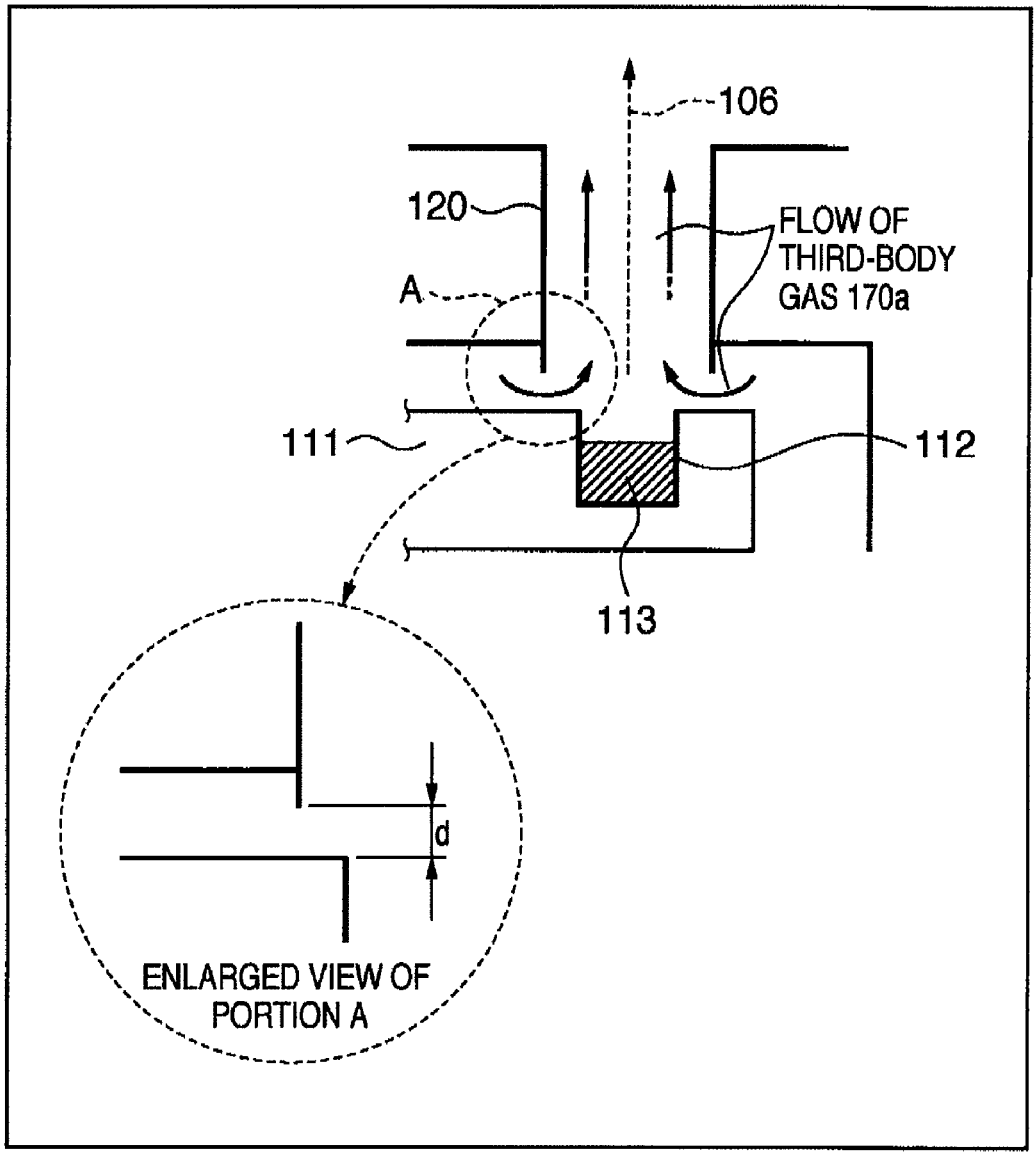
FIG. 2 is an enlarged view of the vicinity of a connecting pipe shown in FIG. 1.

FIG. 2 is an enlarged view showing the vicinity of the connecting pipe in the mass spectrometer (FIG. 1) according to the first embodiment of the present invention.

In FIG. 2, thick arrows indicate the expected flow of the third-body gas 170*a*.

The connecting pipe 120 has an inner diameter of about 6 mm. The gap (vertical gap) between the upper surfaces of the sample cup 112 and probe 111 and the ceiling of the sample evaporation chamber near the inlet of the connecting pipe 120 is about 1 to 2 mm. In FIG. 2, this gap is a distance d between the end of the projecting portion of the connecting pipe 120 toward the sample evaporation chamber 110 in FIG. 2 and the upper surfaces of the sample cup 112 and probe 111.

The flow rate of the third-body gas 170*a* is set to about 5 to 10 sccm, so the linear velocity of the flow of the third-body gas 170*a* inside the connecting pipe 120 and near its inlet is 2 to 5 m/sec. Although the pressure is about 1/1000 of the atmospheric pressure, the mean free path is about 0.1 mm and the third-body gas 170*a* forms a viscous flow.

The viscous flow is a gas flow when the mean free path of gas is much smaller than the representative dimension of a surrounding cell or wall. Another coexistent gas is entirely involved in this flow and moves almost together.

The flow of the third-body gas 170*a* is expected to produce an ascending force for moving up the neutral gas phase molecules 106, and reduce various kinds of influence caused by diffusion and adsorption/desorption in the sample evaporation chamber 110 and connecting pipe 120. In the arrangement shown in FIG. 5, the neutral gas phase molecules 106 move toward the ionization chamber 100 by self-diffusion or the like. In the embodiment, the flow of the third-body gas 170*a* also generates an ascending force for moving up the neutral gas phase molecules 106, in addition to the self-diffusion.

As for the influences of the volume and wall of the sample evaporation chamber 110, the influence of the sample evaporation chamber 110 on the third-body gas 170*a* disappears as if the sample evaporation chamber 110 did not exist in terms of performance, as long as no gas flows reversely (toward the sample evaporation chamber 110) owing to the involvement in the flow of the third-body gas 170*a*, in other words, a perfect gas seal is formed at the gap near the inlet of the connecting pipe 120. This effect is enhanced more as the gap near the inlet of the connecting pipe 120 becomes narrower and the flow velocity becomes higher. However, the gap size is limited by design and dimensional conditions such as the insertion (horizontal movement) of the probe 111 and the proper position of the sample cup 112.

Figure 3A:
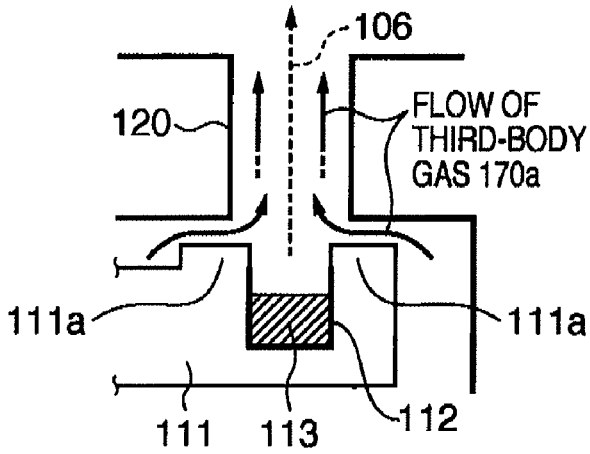
FIG. 3A is an enlarged view showing a modification of the arrangement near the connecting pipe shown in FIG. 1.
Figure 3B:
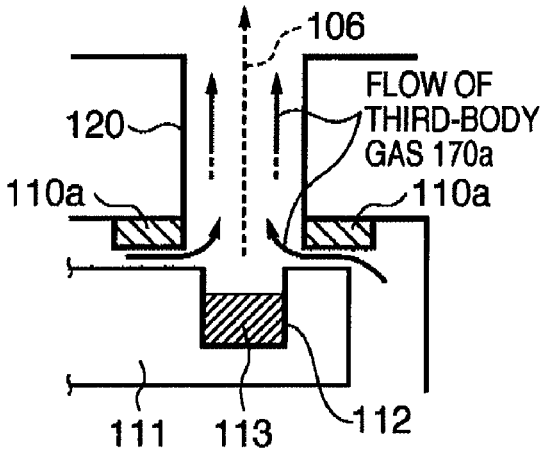
FIG. 3B is an enlarged view showing a modification of the arrangement near the connecting pipe shown in FIG. 1.
Figure 3C:
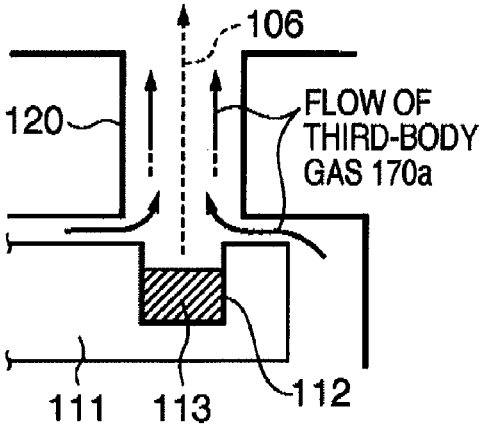
FIG. 3C is an enlarged view showing a modification of the arrangement near the connecting pipe shown in FIG. 1.

FIGS. 3A to 3C show modifications of the arrangement near the connecting pipe 120. To narrow the gap, the connecting pipe 120 extends into the sample evaporation chamber 110 in FIG. 2. Instead, a protrusion 111*a* is formed at the probe 111 in FIG. 3A, a protrusion 110*a* is formed on the ceiling of the sample evaporation chamber 110 in FIG. 3B, and the entire probe 111 is made thick in FIG. 3C. In FIG. 3A, the protrusion (projection) 111*a* is formed at the probe 111 in correspondence with the periphery of the connecting pipe 120. In FIG. 3B, the protrusion (projection) 110*a* is formed at the periphery of the connecting pipe 120 in the sample evaporation chamber 110. The protrusions (projections) 111*a* and 110*a* define the interval between the connecting pipe 120 and the probe 111.

The ascending force of the neutral gas phase molecules 106 from the sample cup 112 to the ionization chamber 100 and the influence of adsorption/desorption in the connecting pipe 120 will be examined. A higher linear velocity of gas and a less turbulence (turbulent flow) are more effective. Thus, for example, the connecting pipe 120 is made long with a small inner diameter. This can increase the linear velocity within the connecting pipe 120, decrease the turbulence, and enhance the ascending force. However, the increase in area results in a greater influence of adsorption/desorption, frequently causing the turbulence at the inlet of the connecting pipe 120. In addition, a point-ahead angle defined by the sample cup 112 becomes small, increasing the loss. The pressure and flow rate, which dominantly determine the viscosity and linear velocity of gas, are decided by another element such as the attachment efficiency and vacuum pump. It is therefore difficult to arbitrarily change the pressure and flow rate.

Accordingly, it was confirmed that the sensitivity (signal strength for the same amount of sample) was about 50 times higher than that in the arrangement of FIG. 5, and reproducibility (reproducibility of the signal strength), responseness (followability to a signal change), and memory (influence of previous measurement on the next one) were also improved at least several times. The action and effect of the third-body gas 170*a* in the ionization chamber 100 were the same as those in the arrangement of FIG. 5 and did not have any problem.

(Second Embodiment)

Figure 4:
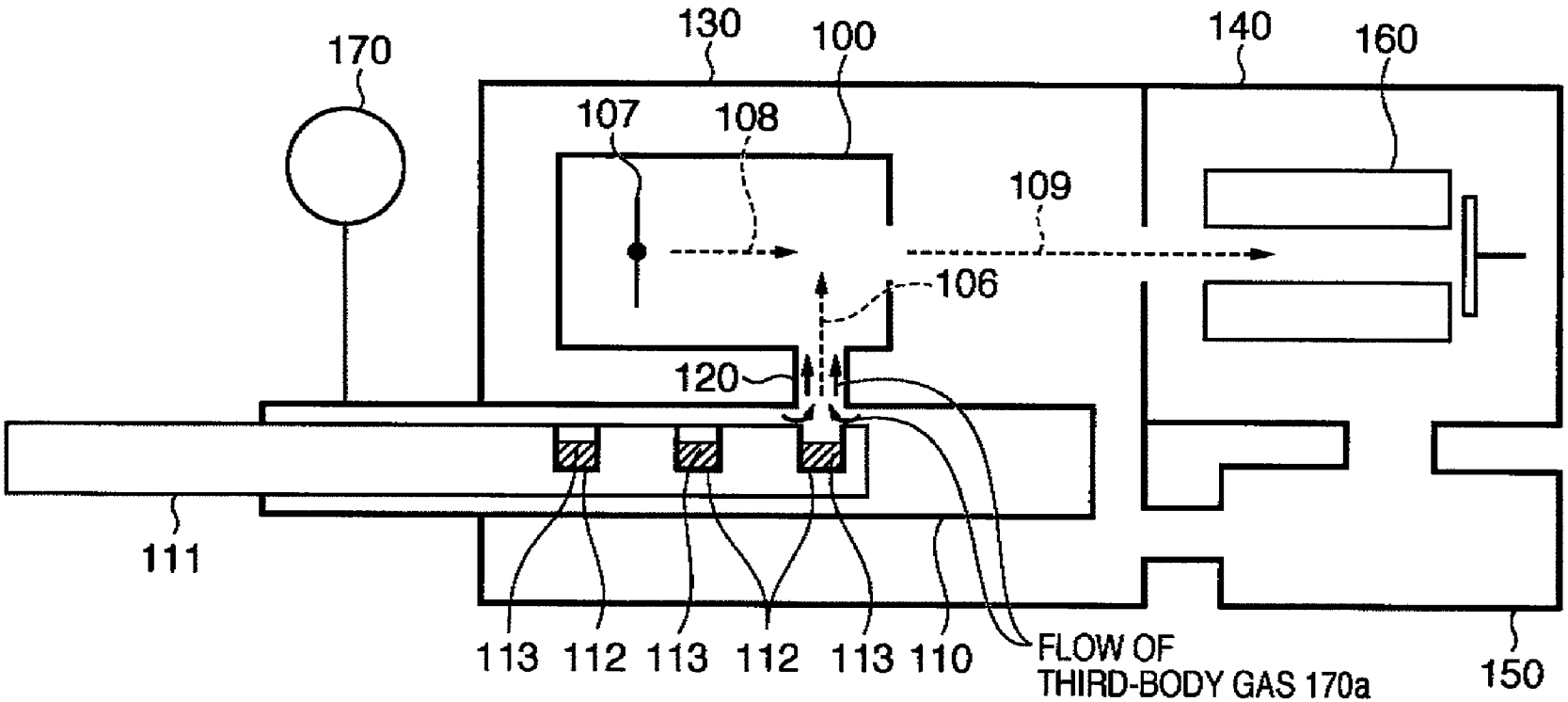
FIG. 4 is a sectional view showing the overall arrangement of a mass spectrometer according to the second embodiment of the present invention.

FIG. 4 shows a mass spectrometer according to the second embodiment of the present invention. This mass spectrometer is identical to that in FIG. 1 except that a plurality of sample cups 112 serving as holders are provided at the distal end of a probe 111. To load the sample cup 112 (containing a sample 113) from the outside into an evacuated sample evaporation chamber 110, the probe 111 needs to be inserted via a preliminary exhaust chamber and valve (neither is shown), and the manipulation times of them are bottlenecks. However, if the probe 111 has a plurality of sample cups 112 (samples 113), like the second embodiment, the next sample can be quickly measured by only moving the probe 111. The reason why the sample cups 112 can be arranged at arbitrary locations of the probe 111 is that the probe 111 can move freely with a narrow gap formed near the inlet of a connecting pipe 120.

In the above embodiments, the metal ions 108 used in the ion attachment method are not limited to the most common $Li^+$, but can also be $K^+$, $Na^+$, $Rb^+$, $Cs^+$, $Al^+$, $Ga^+$, $In^+$, and the like. The ionization method is not limited to the ion attachment method and is any fragment-free ionization method capable of generating molecular ions by ionizing the neutral gas phase molecules 106 in the original form without decomposing them. For example, PTR (Proton Transfer Reaction, http://www.ptrms.com/index.html) for attaching $H^+$ (protons) from $H_3O$ ions, or IMS (Ion Molecule Spectrometer, http://www.vandf.com/) using charge exchange from mercury ions or the like is usable.

As the mass spectrometer 160, a variety of mass spectrometers are available, including a quadrupole mass spectrometer (QMS), ion trap (IT) mass spectrometer, magnetic sector (MS) mass spectrometer, time-of-flight (TOF) mass spectrometer, and ion cyclotron resonance (ICR) mass spectrometer. As the overall structure, a two-chamber structure having the first cell 130 with the ionization chamber 100 and the second cell 140 with the mass spectrometer 160 has been exemplified. However, the present invention is not limited to this.

In the fragment-free ionization method, the pressure in a space outside the ionization chamber is 0.01 to 0.1 Pa. A one-chamber structure is possible for a mass spectrometer capable of operating at this pressure. For a mass spectrometer that requires a much lower pressure, a three- or four-chamber structure is necessary. Generally, it is supposed to be appropriate to use a one-chamber structure for a microminiaturized QMS or IT, a two-chamber structure for a normal QMS or MS, a three-chamber structure for a TOF, and a four-chamber structure for an ICR.

Industrial Applicability

The present invention enables the "direct measurement method" in mass spectrometry with excellent performance and is preferably applicable to a wide range of fields including material development, product inspection, environmental research, and biotechnology.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-253915, filed Sep. 30, 2008, which is hereby incorporated by reference herein in its entirety.

The invention claimed is:

1. A mass spectrometer comprising:

an ionization chamber which generates fragment-free ions to be detected from an introduced gas to be detected;

a mass spectrometer chamber including a mass spectrometer which fractionates by mass the ions to be detected that are transported from said ionization chamber and which detects the ions;

a probe which holds a liquid sample or a solid sample and causes the liquid sample or the solid sample to generate the gas to be detected upon heating by heating means;

a sample evaporation chamber which is connected to said ionization chamber via a connecting pipe; and introduction means for introducing a predetermined gas from said probe to said ionization chamber to transport, to said ionization chamber, the gas to be detected that is generated at said probe, wherein said probe is arranged in said sample evaporation chamber, and said introduction means is connected to said sample evaporation chamber.

2. The mass spectrometer according to claim 1, wherein said probe includes a holder which holds the liquid sample or the solid sample, and a plurality of holders are arranged.

3. The mass spectrometer according to claim 1, wherein a projection is arranged around the connecting pipe in said probe or said sample evaporation chamber to define a distance between the connecting pipe and said probe.

4. The mass spectrometer according to claim 3, wherein a third-body gas flowing beside the projection forms a viscous flow.

5. The mass spectrometer according to claim 1, wherein the connecting pipe connects said ionization chamber and said sample evaporation chamber in a vertical direction.

6. The mass spectrometer according to claim 1, wherein the predetermined gas is a third-body gas.

7. A mass spectrometry method using a mass spectrometer including:

an ionization chamber which generates fragment-free ions to be detected from an introduced gas to be detected;

a mass spectrometer chamber having a mass spectrometer which fractionates by mass the ions to be detected that are transported from the ionization chamber and which detects the ions;

a probe which holds a liquid sample or a solid sample and causes the liquid sample or the solid sample to generate the gas to be detected upon heating by heating means, and a sample evaporation chamber which is connected to said ionization chamber via a connecting pipe, the method comprising:

introducing a predetermined gas from the probe to the ionization chamber to transport, to the ionization chamber via the connecting pipe, the gas to be detected that is generated at the probe upon heating.

8. The mass spectrometry method according to claim 7, wherein the predetermined gas is a third-body gas that is used to generate the ions to be detected by attaching metal ions to gas molecules to be detected that are generated upon heating by the heating means.

* * * * *